US007229360B2

(12) United States Patent
Chevillotte

(10) Patent No.: US 7,229,360 B2
(45) Date of Patent: Jun. 12, 2007

(54) TABLE WHICH CAN BE CONVERTED INTO A BILLIARD TABLE

(75) Inventor: Claude Chevillotte, Saint Jean le Blanc (FR)

(73) Assignee: Etablissements Chevillotte, Orleans (FR)

( * ) Notice: Subject to any disclaimer, the term of this patent is extended or adjusted under 35 U.S.C. 154(b) by 0 days.

(21) Appl. No.: 10/981,659

(22) Filed: Nov. 5, 2004

(65) Prior Publication Data

US 2005/0101396 A1 May 12, 2005

(30) Foreign Application Priority Data

Nov. 6, 2003 (FR) ..... 03 13065

(51) Int. Cl.
*A63D 15/00* (2006.01)

(52) U.S. Cl. ..... 473/4; 473/31; 473/8

(58) Field of Classification Search ..... 473/1, 473/4, 6, 7, 8, 9, 10, 11, 14, 18; 273/309; 108/144.11

See application file for complete search history.

(56) References Cited

U.S. PATENT DOCUMENTS

| | | | | | |
|---|---|---|---|---|---|
| 945,150 | A * | 1/1910 | Barrett | 473/30 |
| 1,540,316 | A | 6/1925 | Clement | |
| 2,008,613 | A * | 7/1935 | Hernes | 108/90 |
| 2,572,333 | A * | 10/1951 | Greitzer | 108/90 |
| 2,719,717 | A * | 10/1955 | Verity | 273/126 R |
| 3,941,378 | A * | 3/1976 | Bagley | 473/10 |
| 4,345,758 | A * | 8/1982 | Kempf | 473/475 |
| 4,768,781 | A * | 9/1988 | McMillin | 473/16 |
| 4,989,863 | A * | 2/1991 | Hall | 473/15 |
| 6,102,808 | A * | 8/2000 | Wong | 473/12 |
| 6,659,879 | B1 * | 12/2003 | Cartwright | 473/8 |
| 6,962,535 | B2 * | 11/2005 | Cartwright | 473/8 |

FOREIGN PATENT DOCUMENTS

| | | |
|---|---|---|
| DE | 15440 | 9/1881 |
| DE | 35219 | 5/1886 |
| DE | 76152 | 7/1894 |
| DE | 84128 | 9/1894 |
| FR | 2625912 A1 * | 7/1989 |

* cited by examiner

*Primary Examiner*—Mitra Aryanpour
(74) *Attorney, Agent, or Firm*—Young & Thompson

(57) ABSTRACT

The invention relates to a table (1) which can be converted into a billiard table, of the type comprising a rectangular fixed frame which is provided with vertical support feet (11) and which surrounds a rectangular central plate (13) which is covered with a cloth and which is carried by the fixed frame, and a rectangular movable frame (20) which is arranged above the fixed frame and which carries internally an assembly of rebound bands. The movable frame (20) can be displaced vertically between a lower position, forming a table, and two upper positions, in which the inner edge of the assembly of bands is, relative to the central plate, at a height for American billiards, then at a height for French billiards, respectively.

19 Claims, 12 Drawing Sheets

TABLE WHICH CAN BE CONVERTED INTO A BILLIARD TABLE

TECHNICAL FIELD

The present invention relates to a table which can be converted into a billiard table of the American or French type.

BACKGROUND

Billiard tables of the French type comprise a rectangular central plate which is covered with a cloth and which forms a planar rolling surface which is bordered by a frame, inside which an assembly of rebound bands which are produced from a resilient material, such as, for example, rubber, is arranged in order to cause the billiard balls to rebound.

In the case of billiard tables of the American type, the assembly of bands comprises circular-arc-shaped recesses which are arranged at the corners of the frame and also at the centre of the long sides of this frame. In that case, a longitudinal gutter for recovering the balls is arranged below each long side of the frame.

It is known to convert American billiard tables into French billiard tables by providing a closure member in each recess in order to form a continuous band over the entire periphery of the central plate.

However, this arrangement has a disadvantage in that the height of the band is identical for the two types of billiard table, whereas in reality the height of the band must be greater for French billiards than it is for American billiards.

It is also known to convert American billiard tables into French billiard tables by a system of removable bands which allow the bands provided with recesses to be replaced with bands which are continuous over the entire periphery of the plate.

In that case, the conversion requires a given number of manipulations.

It is also known to convert a French or American billiard table into a table. In that case, the central plate as well as the bands are covered with a panel of wood or any other material which forms a table top. However, this arrangement has a disadvantage principally in that the covering panel has a height which corresponds to the height of the bands, that is to say, a height in the order of 80 cm (31.5 inches), that is, a height greater than the height of a conventional table.

The covering panel has large dimensions and weight, which does not facilitate its manipulation. Furthermore, the panel takes up a large amount of space during the use of the billiard table.

Therefore, the object of the invention is to provide a table which can be converted into a billiard table of the French type or American type which overcomes the above-mentioned disadvantages.

SUMMARY

Therefore, the invention relates to a table which can be converted into a billiard table, characterised in that it comprises:

- a rectangular fixed frame which is provided with vertical support feet and which surrounds a rectangular central plate which is covered with a cloth and which is carried by the frame, and
- a rectangular movable frame which is arranged above the fixed frame and which carries internally an assembly of rebound bands, the movable frame being displaceable by control means vertically between a lower position, forming a table, and two upper positions, in which the inner edge of the assembly of bands is, relative to the central plate, at a height for American billiards, then at a height for French billiards, respectively.

According to other features of the invention:

- the fixed frame provides, with the peripheral edge of the central plate, an annular free space for positioning the assembly of bands in the lower position of the movable frame,
- the movable frame comprises, in the region of each foot of the fixed frame, a vertical cover which covers at least partially the corresponding foot,
- the sides of the fixed frame are formed by U-shaped profile sections, inside which means for controlling the displacement of the movable frame are accommodated,
- the control means comprise at least two horizontal runners which are arranged at two opposite sides of the fixed frame and which support the movable frame, the runners being displaceable simultaneously and vertically by an assembly of struts between a position retracted inside the profile section of the fixed frame, corresponding to the lower position of the movable frame, and two deployed positions, each corresponding to an upper position of the movable frame,
- each assembly of struts comprises two pairs of opposite struts, each having a first end which is articulated to the corresponding runner and a second end which is articulated to a carriage which is arranged in the corresponding profile section of the fixed frame, the carriages of the two pairs of struts of the same assembly being displaceable towards each other by actuation elements between the retracted position and the deployed positions of the corresponding runner and away from each other between the deployed positions and the retracted position of the runner,
- the actuation elements comprise a nut which is fixedly joined to each carriage and two worm screw portions for movement in translation, each co-operating with a nut, the screw portions of the carriages of the same assembly of struts having threads of the opposite direction and the screw portions of the carriages of the assemblies of struts being connected to each other and caused to rotate by rods which are themselves caused to rotate by an operating member,
- the operating member comprises a crank which is positioned outside one of the sides of the fixed frame and which is connected to the rods by a bevel gear,
- the table comprises means for blocking the rotation of the rods and screw portions in each upper position of the movable frame,
- the blocking means comprise a carriage which is arranged in one of the profile sections of the fixed frame and which comprises a nut which engages with a worm screw portion which is caused to rotate by one of the rods, a fixed stop which is arranged in the continuation of the worm screw portion and a latch which can be tilted vertically between a retracted position, opening up the space between the nut and the stop, and a position interposed between the nut and the stop,
- the assembly of bands comprises, at each corner and at the centre of the long sides, a circular-arc-shaped recess which is intended to be closed temporarily by a removable closure member when the movable frame is in the position for French billiards,
- the table comprises, below each long side of the fixed frame, a longitudinal gutter which can be displaced by the movable frame between a rest position retracted in the region of the free space between the fixed frame and the plate in the lower position of the movable frame, and an active position below this annular space in order to recover the balls in the first upper position of the movable frame.

BRIEF DESCRIPTION OF THE DRAWINGS

The features and advantages of the invention will be appreciated from the description below which is given by way of example and with reference to the appended drawings, in which.

DESCRIPTION

FIGS. 1 to 4 illustrate a table which is generally designated 1 and which can be converted, in a first configuration (FIG. 1), into a table of conventional type, in a second configuration (FIG. 2), into a table of the type for board games, in a third configuration (FIG. 3), into a table of the type for American billiards and, in a fourth configuration (FIG. 4), into a table of the type for French billiards.

Figure 5:
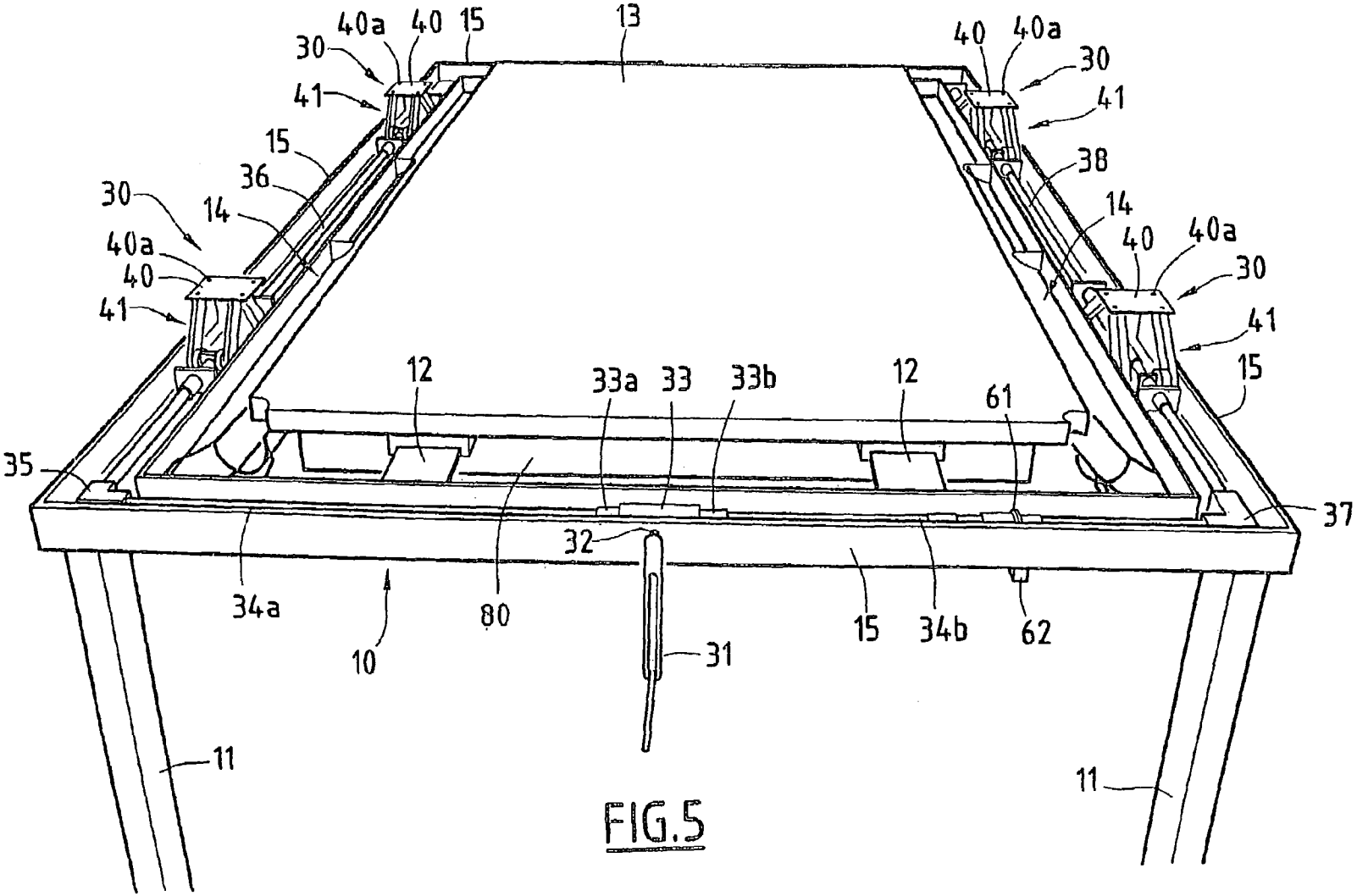
FIG. 5 is a perspective view of the fixed frame and the plate of the table according to the invention.

For this purpose and as illustrated in FIG. 5, the table 1 comprises a rectangular fixed frame 10 which is provided with vertical support feet 11 which are arranged at each corner of the fixed frame 10. The fixed frame 10 supports, by means of cross-pieces 12, a rectangular central plate 13 which is covered with a cloth and which is produced, for example, from slate in order to obtain a completely planar surface. A strip of wood, not illustrated, is interposed between each cross-piece 12 and the plate 13. Each foot 11 is provided with a height adjustment system (not illustrated) which allows the horizontality of the plate 13 to be adjusted.

The cross-pieces 12 are arranged at the short sides of the fixed frame 10 and the central plate 13 in such a manner that a free space 14 is provided between the long sides of the fixed frame 10 and the central plate 13. Each side of the fixed frame 10 is constituted by a U-shaped profile section 15.

Figures 6, 7:
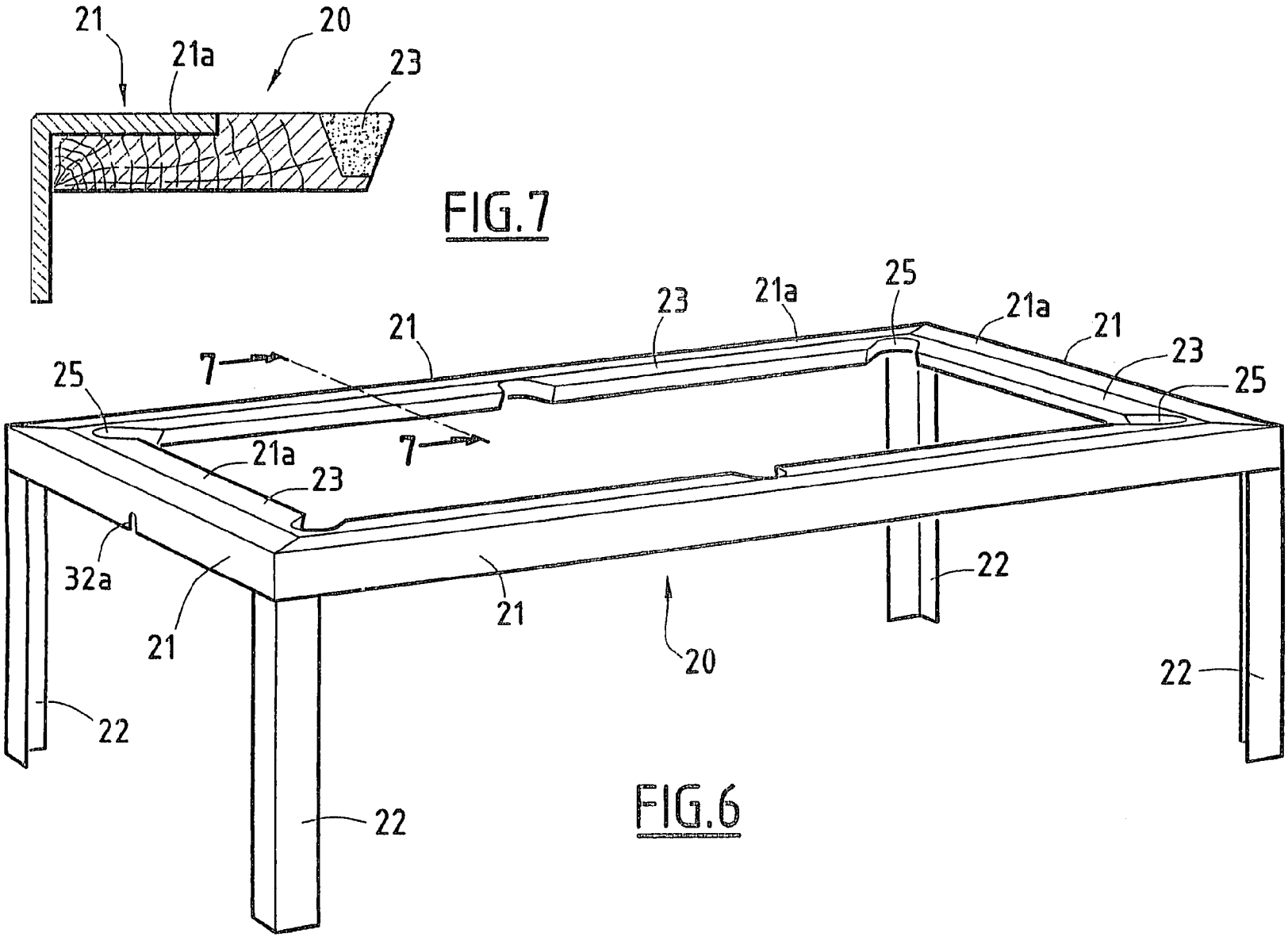
FIG. 6 is a perspective view of the movable frame of the table according to the invention.
FIG. 7 is a schematic cross-section along line 7—7 in FIG. 6.

The table 1 also comprises a movable frame 20 which is illustrated in particular in FIGS. 6 and 7 and which is of rectangular form having substantially the same dimensions as the fixed frame 10. This movable frame 20 is intended to be positioned above the fixed frame 10 and each of the sides thereof is formed by a profile section 21 in the form of an inverted L, as illustrated in FIG. 7. The movable frame 20 comprises, at each of the corners thereof, that is to say, in the region of each foot 11 of the fixed frame 10, a vertical cover 22 which is formed by an L-shaped corner bracket in order to cover at least partially the corresponding foot 11 and in particular the portion of the foot 11 visible outside the fixed frame 10.

Each profile section 21 of the movable frame 20 carries internally a rebound band 23 which is produced, for example, from resilient material, such as rubber. The movable frame 20 can be displaced by control means which are generally designated 30 (FIG. 5) between a lower position, which forms a table and in which the movable frame 20 rests against the fixed frame 10 (FIGS. 1 and 2), and two upper positions, in which the inner edge of the assembly of bands 23 is, relative to the central plate 13, at a height for American billiards (FIG. 3), then at a height for French billiards (FIG. 4), respectively.

In the lower position of the movable frame 20, the vertical covers 22 completely cover the portion of the feet 11 seen from outside the table 1.

Figure 1:
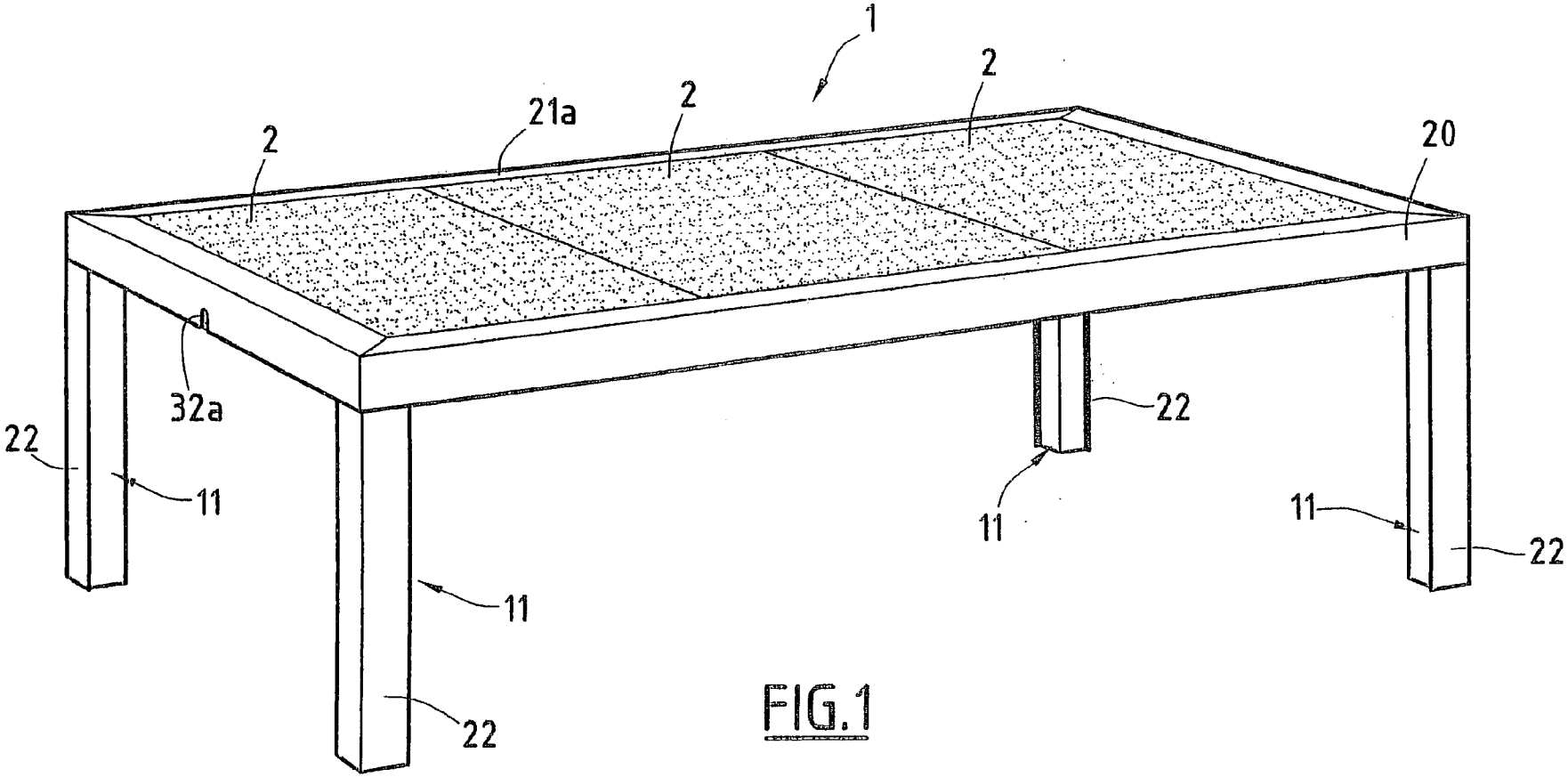
FIG. 1 is a perspective view of a convertible table according to the invention.
Figure 2:
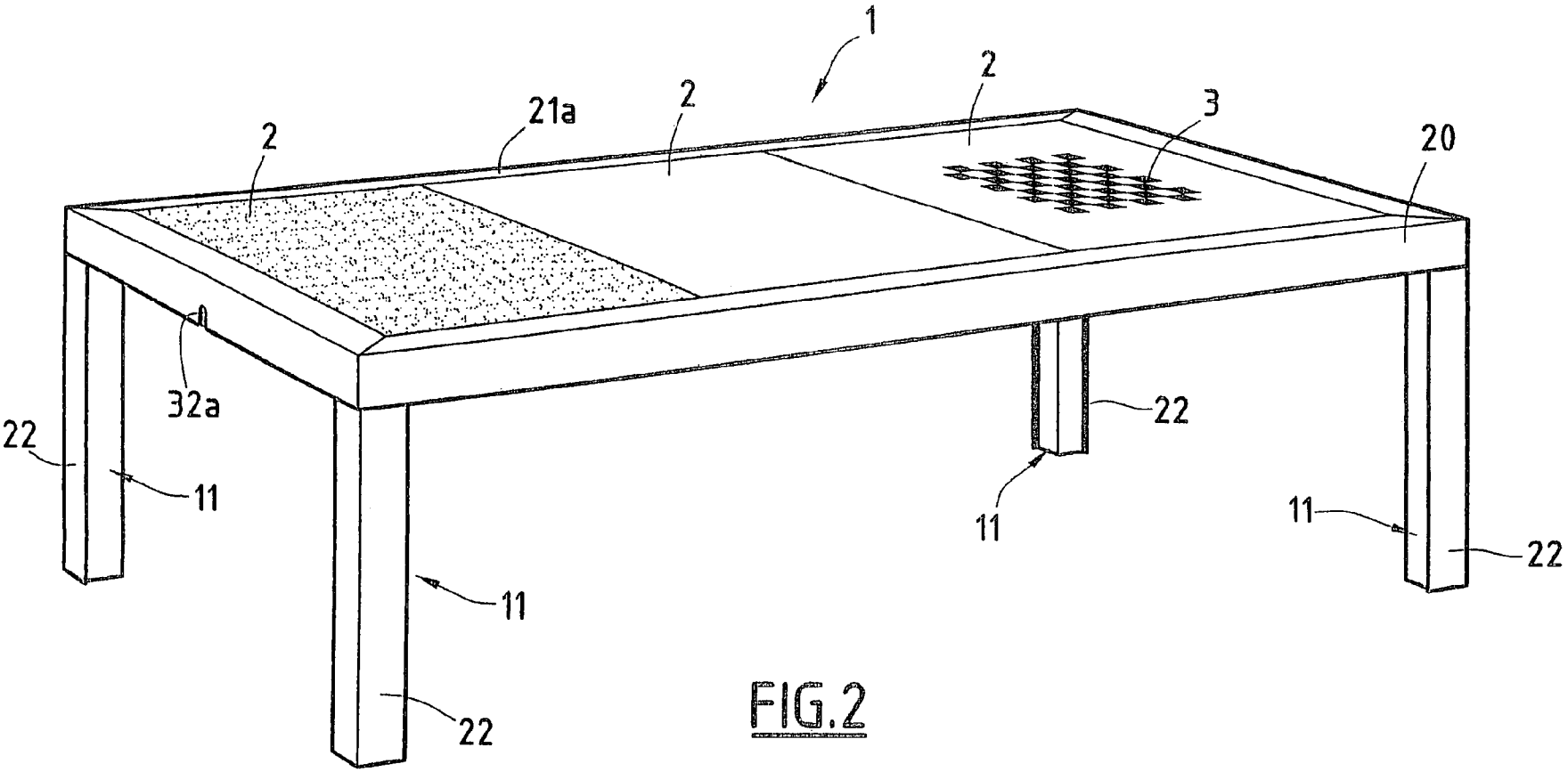
FIG. 2 is a perspective view of the table in a configuration for games.
Figure 3:
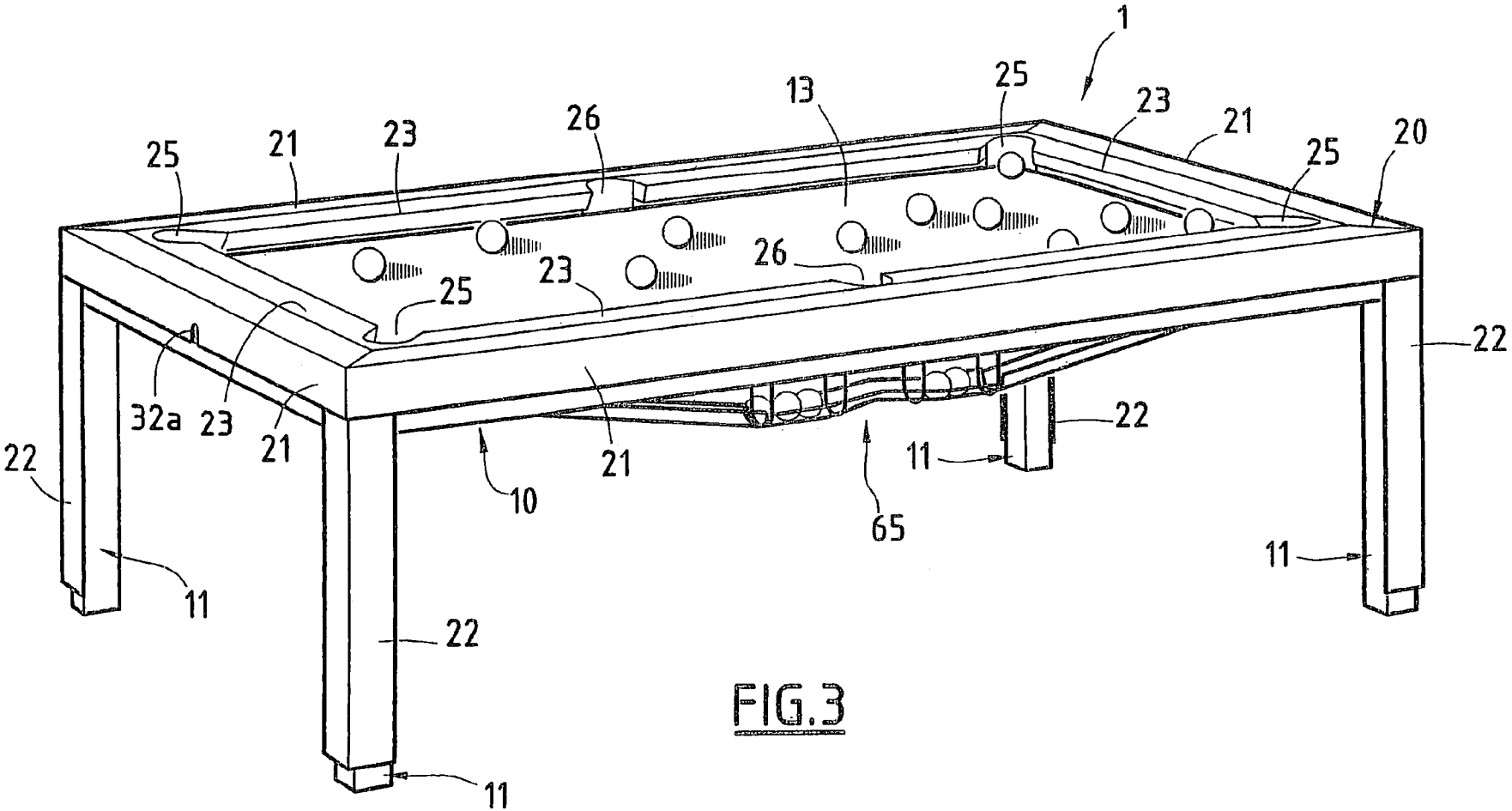
FIG. 3 is a perspective view of the table in the configuration for American type billiards.
Figure 4:
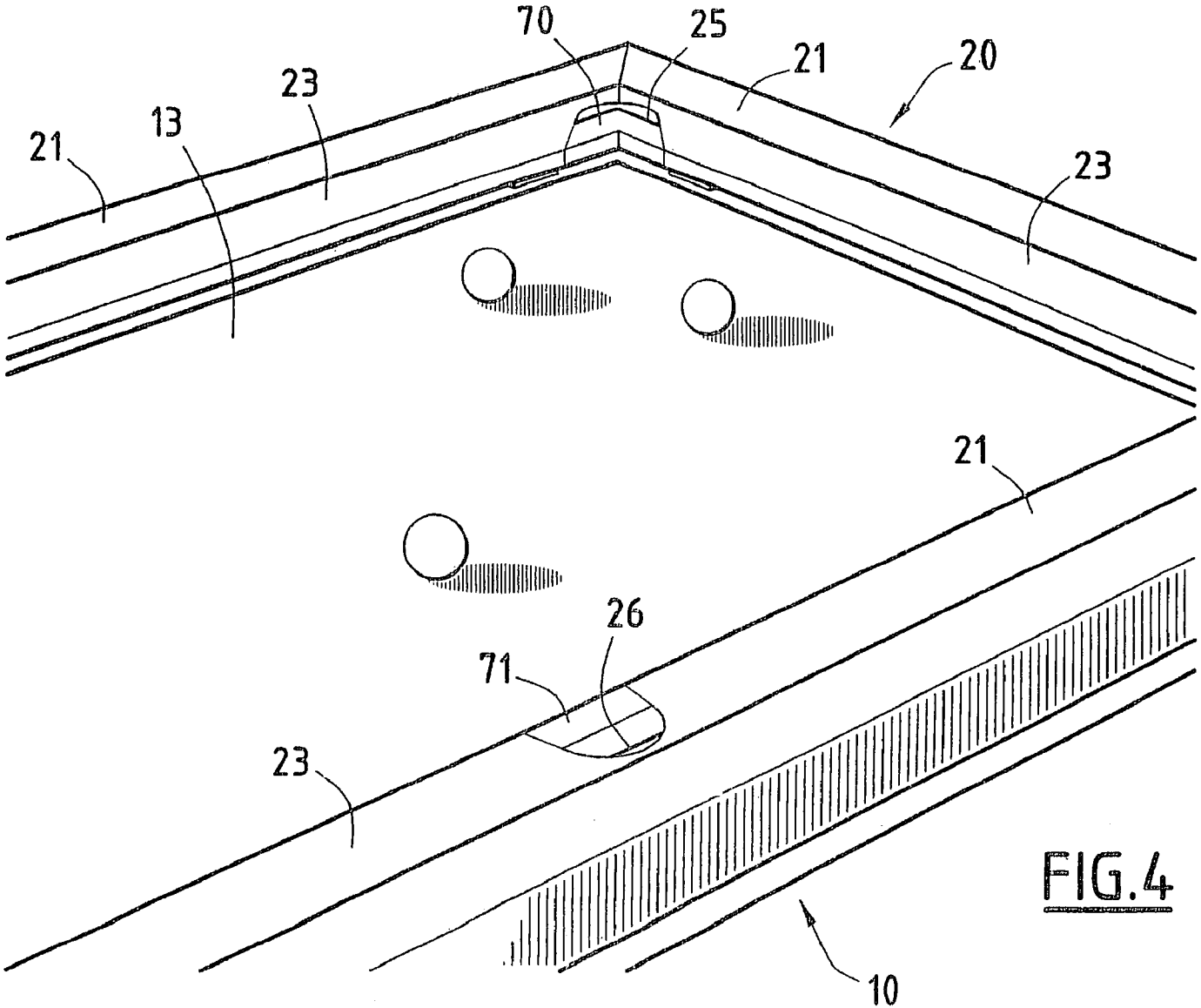
FIG. 4 is a partial perspective view of the table in the configuration for French type billiards.

In this configuration of the conventional table type, the central plate 13 is covered by at least one protection panel 2 and, in the embodiment illustrated in FIGS. 1 and 2, the central plate 13 is covered by three juxtapositioned protection panels 2. These panels 2 are covered, for example, with leather, or are of brushed aluminium or wood, and can comprise, on one of the faces thereof, a games cloth comprising printed patterns 3, such as, for example, a game of checkers or chess. The panels 2 are therefore reversible and they can be turned over independently of each other depending on the use of the table (FIG. 2).

Figure 8:
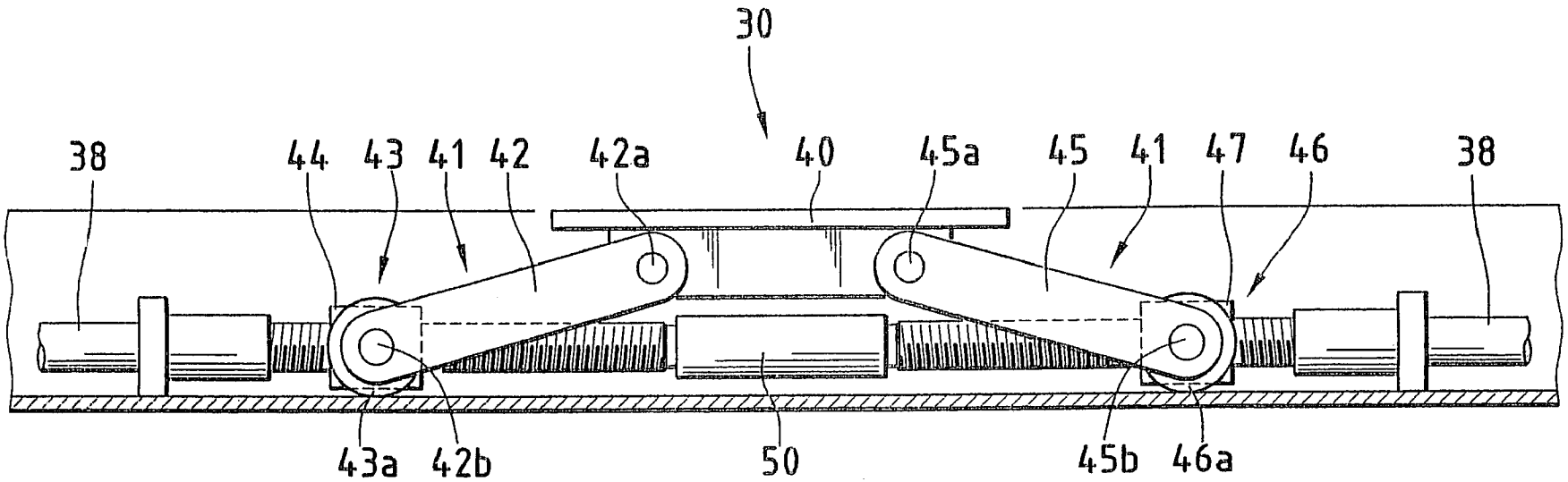
FIG. 8 is a schematic perspective view of the means for controlling the displacement of the movable frame in the retracted position.
Figure 9:
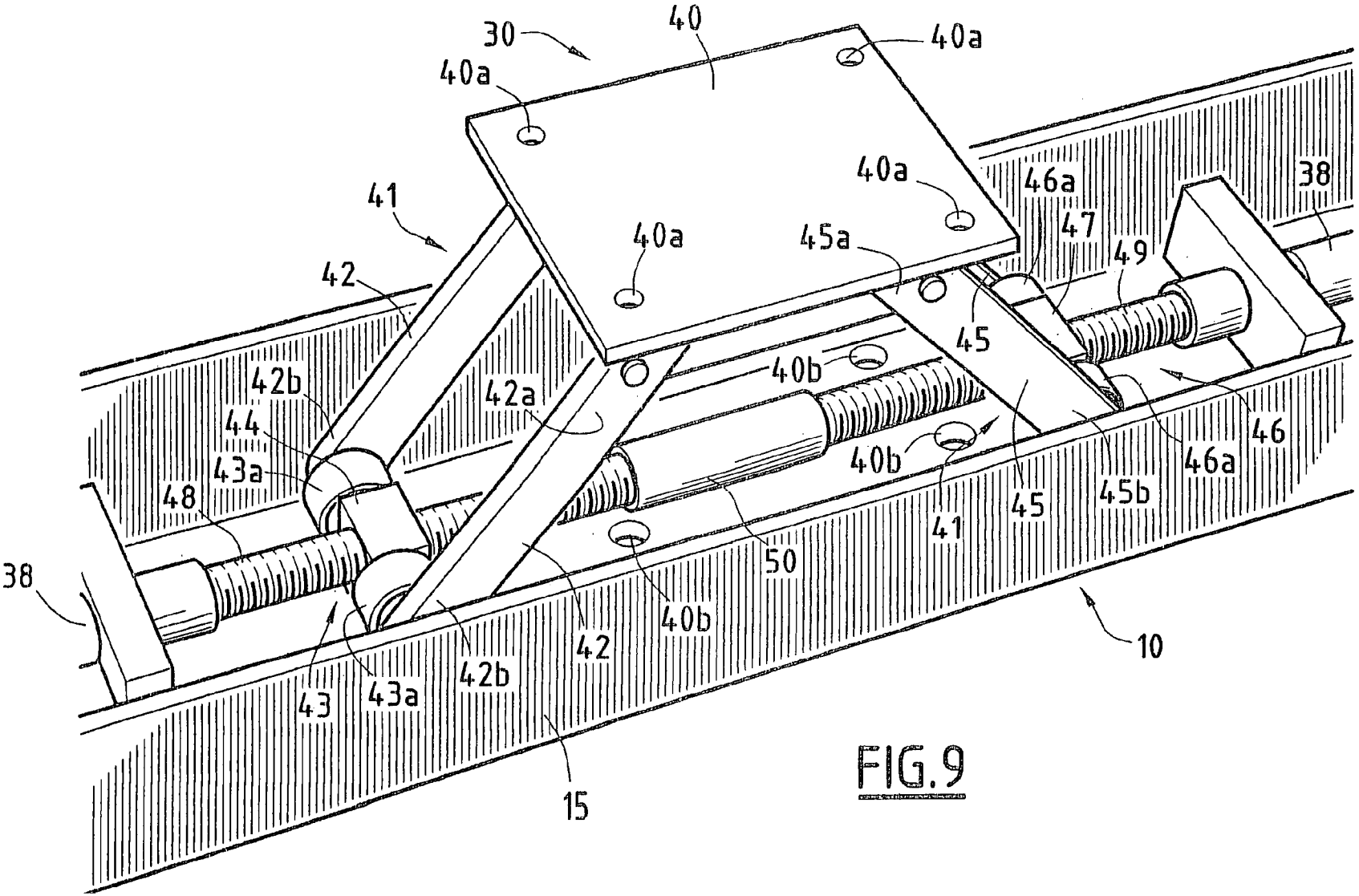
FIG. 9 is a schematic perspective view of the means for controlling the displacement of the movable frame in the deployed position.

With reference now to FIGS. 5, 8 and 9, the means 30 for controlling the displacement of the movable frame 20 depending on the use of the table 1 will now be described.

The means 30 for controlling the displacement of the movable frame 20 are constituted by an operating member 31 which is formed, for example, by a crank, which is intended to cooperate with a transverse rod 32 which extends through the profile section 15 of a short side of the fixed frame 10, as shown in FIG. 5. A recess 32*a* (FIG. 6) is provided in the corresponding short side of the profile section 21 of the movable frame 20.

The transverse rod 32 opens inside the profile section 15 of the short side of the fixed frame 10 and is connected to a bevel gear-box 33, of known type, comprising a system of gears for transmitting the rotation movement of the rod 32 which is driven by the crank 31 in various directions. The bevel gear-box 33 comprises two outputs 33*a* and 33*b*, each provided with a rod 34*a* and 34*b*, respectively. The rods 34*a* and 34*b* are both opposed and arranged in the profile-section 15 which forms a short side of the fixed frame 10. The rod 34*a* is connected, by a bevel gear-box 35, to a rod 36 which extends over the entire length of the adjacent long side of the fixed frame 10. Similarly, the rod 34*b* is connected, by a bevel gear-box 37, to a rod 38 which extends over the entire length of the adjacent long side of the fixed frame 10. The rods 36 and 38 are arranged inside the profile section 15 of the fixed frame 10. When the crank 31 is caused to rotate, the rods 34*a*, 34*b*, 36 and 38 are also caused to rotate.

The control means 30 also comprise at least two horizontal runners 40 which are arranged at two opposite sides of the fixed frame 10 and which support the movable frame 20.

Preferably, and as illustrated in the embodiment in FIG. 5, a total of four runners 40 are arranged in pairs at each long side of the fixed frame 10. These runners 40 can each be displaced simultaneously and vertically by an assembly of struts 41 between a position retracted inside the profile section 15 of the fixed frame 10, corresponding to the lower position of the movable frame 20, and two deployed positions, each corresponding to an upper position of the movable frame 20. Each runner 40 is provided with openings 40*a* (FIGS. 5 and 9) for the introduction of a screw type element (not illustrated), such as, for example, a screw, into each opening 40*a* of the movable frame 20 at the corresponding runner 40. To this end, the base of the profile section 15 is perforated with openings 40*b* (FIG. 9) for the introduction of a screwing tool for each screw type element.

With reference now to FIGS. 8 and 9, an assembly of struts 41 of a runner 40 will now be described, the assembly of struts 41 of the other runners 40 being identical.

As shown in these FIGS., the assembly of struts 41 comprises two pairs of opposite struts 42 and 45, respectively. The first pair of struts comprises two parallel struts 42, each having a first end 42*a* which is articulated to the runner 40 and a second end 42*b* which is articulated to a carriage 43 comprising rollers 43*a* which rest on the base of the profile section 15 of the fixed frame 10. The carriage 43 comprises an actuation element which is formed by a nut 44 which engages with a worm screw portion 48 which is caused to rotate by the rod 38.

The second pair of struts comprises two opposite struts 45, each having a first end 45*a* which is articulated to the runner 40 and a second end 45*b* which is articulated to a carriage 46 comprising two rollers 46*a* which rest on the base of the profile section 15 of the fixed frame 10. The carriage 46 comprises an actuation element which is formed by a nut 47 which engages with a worm screw portion 49 which is caused to rotate by the rod 38.

The screw portions 48 and 49 are mutually aligned and connected to each other by a sleeve 50, as shown in FIG. 9. These worm screw portions 48 and 49 have threads of opposing directions so that, when these worm screw portions 48 and 49 are rotated by the rod 38, the carriages 43 and 46 are displaced towards each other between the retracted position of the runner 40 in the corresponding profile section 15 and the deployed positions of this runner 40 for one direction of rotation of the worm screw portions 48, 49, and away from each other between the deployed positions and the retracted position of the runner 40 for an inverted direction of rotation of these worm screw portions 48 and 49.

In this manner, when the rods 34*a*, 34*b*, 36 and 38 are rotated by means of the crank 31, the assembly of the worm screw portions 48 and 49 is caused to rotate and the runners 40 are displaced simultaneously between the retracted position in the profile section 15 of the fixed frame 10 and the deployed positions, or vice versa, by means of the assembly of struts 41 in order to displace the movable frame 20.

The table 1 also comprises means for blocking the rotation of the rods 34*a*, 34*b*, 36 and 38 as well as the screw portions 48 and 49 in each upper position of the movable frame 20.

Figure 10:
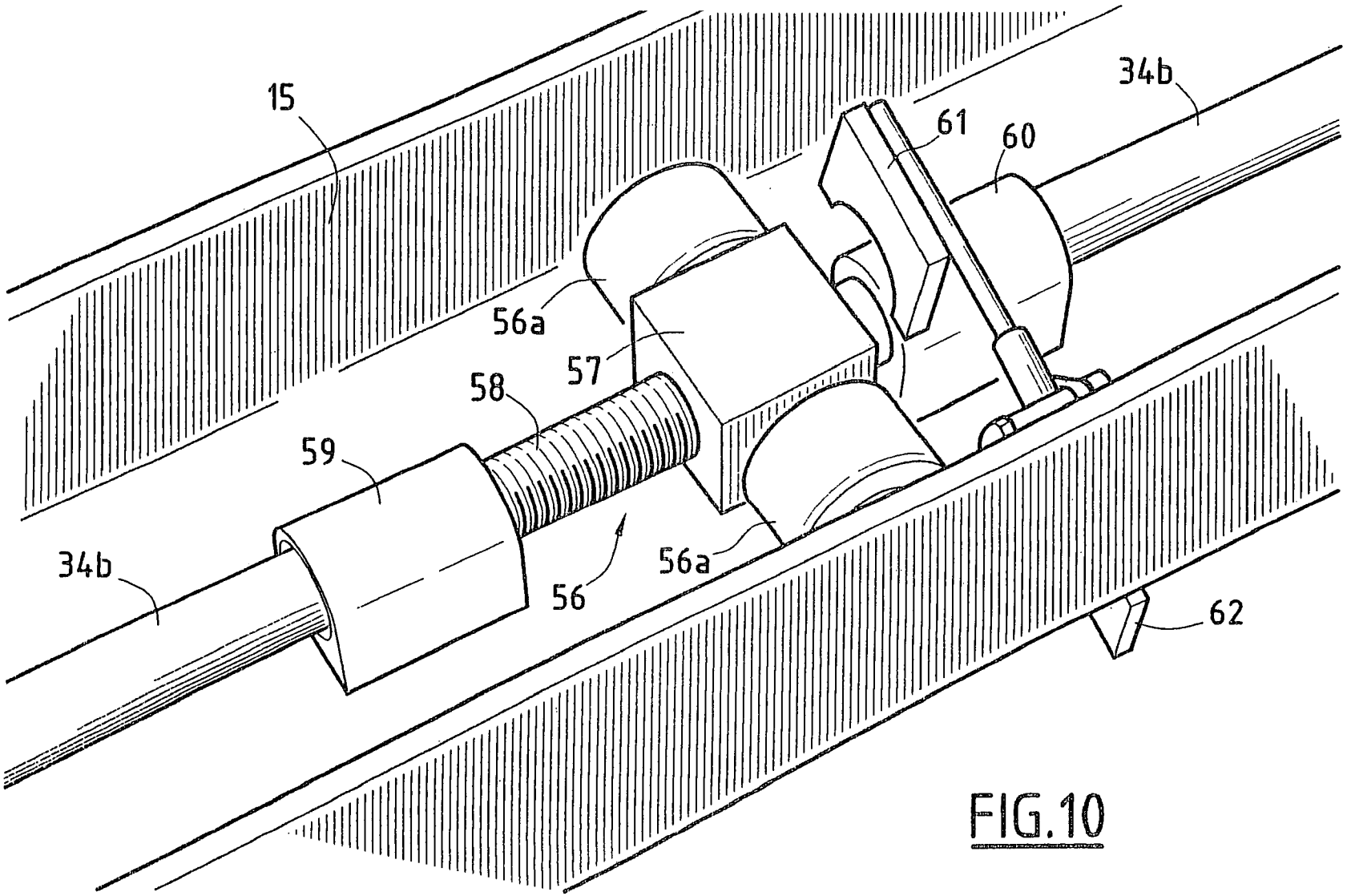
FIGS. 10 and 11 are two schematic perspective views of the blocking means in each upper position of the movable frame in the retracted position and in the active position, respectively.
Figure 11:
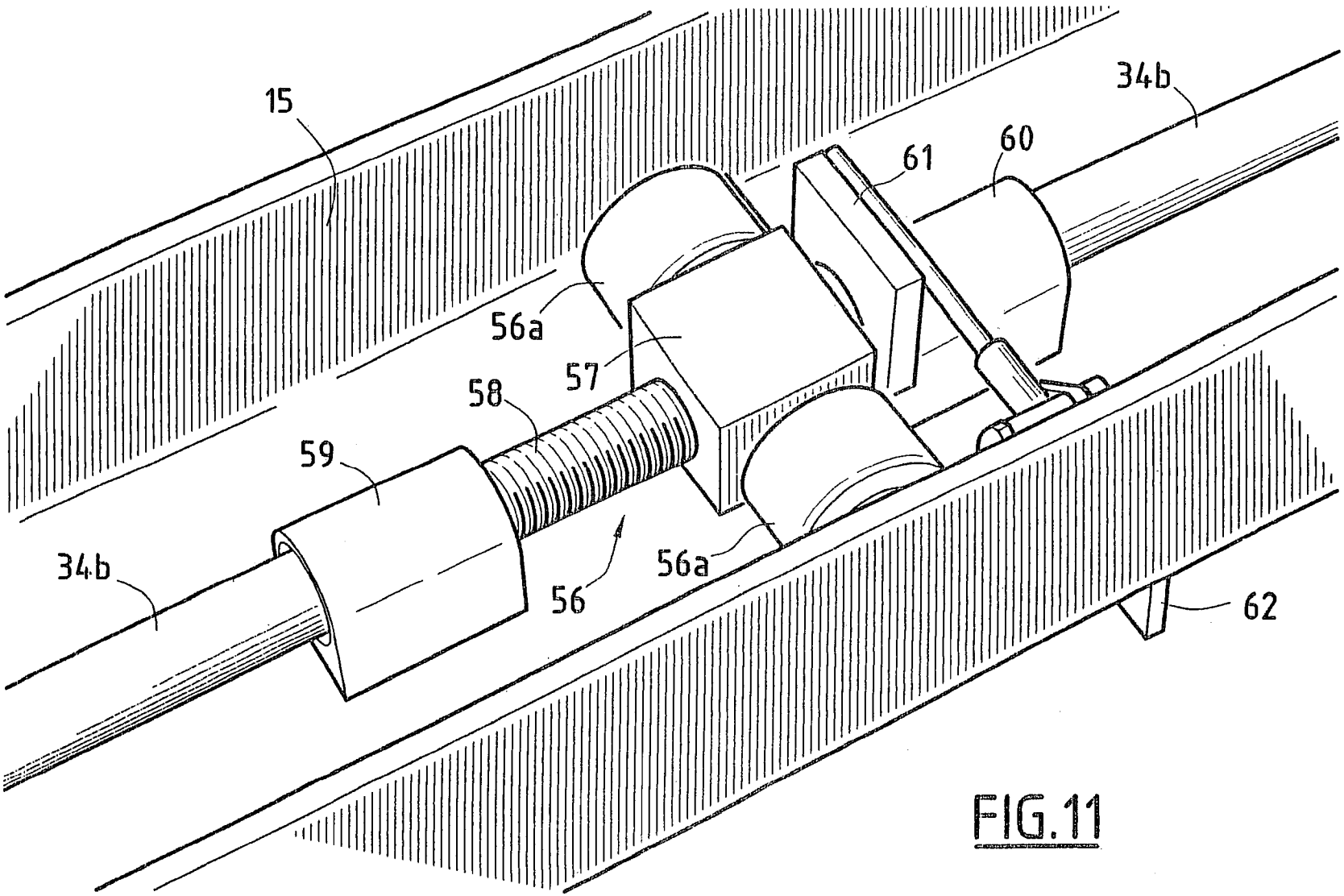

These blocking means which are illustrated in particular in FIGS. 10 and 11, comprise a carriage 56 which is arranged in a profile section 15 of the fixed frame 10 and in particular in the profile section which corresponds to the short side of this fixed frame 10 which comprises the rod 32 which is intended to receive the crank 31. This carriage 56 comprises two rollers 56*a* which rest on the base of the corresponding profile section 15 and a nut 57 which engages with a worm screw portion 58 which is caused to rotate by the rod 34*b*. The screw portion 58 is arranged between two stops 59 and 60 which limit the travel of the carriage 56.

The blocking means also comprise a latch 61 which can be tilted vertically and which is arranged between the nut 57 and the stop 60. The latch 61 is connected to a lever 62 which is arranged on the lower face of the profile section 15 of the fixed frame 10. This lever 62 controls the vertical tilting of the latch 61 between a retracted position opening up the space between the nut 57 and the fixed stop 60 and a position interposed between the nut 57 and the stop 60. In the retracted position of the latch 61, when the screw portion 58 is rotated, the nut 57 comes into contact against the stop 60, which corresponds to the upper position of the runners 40, in which the movable frame 20 is in a configuration for French type billiards. In the position in which the latch 61 is interposed between the nut 57 and the fixed stop 60, when the screw portion 58 is rotated, the nut 57 comes into abutment against the latch 61, thereby limiting the travel of that nut 57 corresponding to the position of the movable frame 20 in a configuration for American type billiards. The thickness of the latch 61 is defined in order to correspond to the desired position of the bands 23.

As FIG. 6 shows, the assembly of bands 23 of the movable frame 20 comprises, at each corner, a circular-arc-shaped recess 25 and, at the centre of each long side, a recess 26 which is also circular-arc-shaped. These recesses 25 and 26 allow the billiard table to be used for American billiards. To that end, the table 1 comprises, below each long side of the fixed frame 10, a longitudinal gutter which is generally designated 65 and which is intended to recover the balls which fall through the recesses 25 and 26 at each long side of the movable frame 20. The two gutters 65 are identical.

Figure 12:
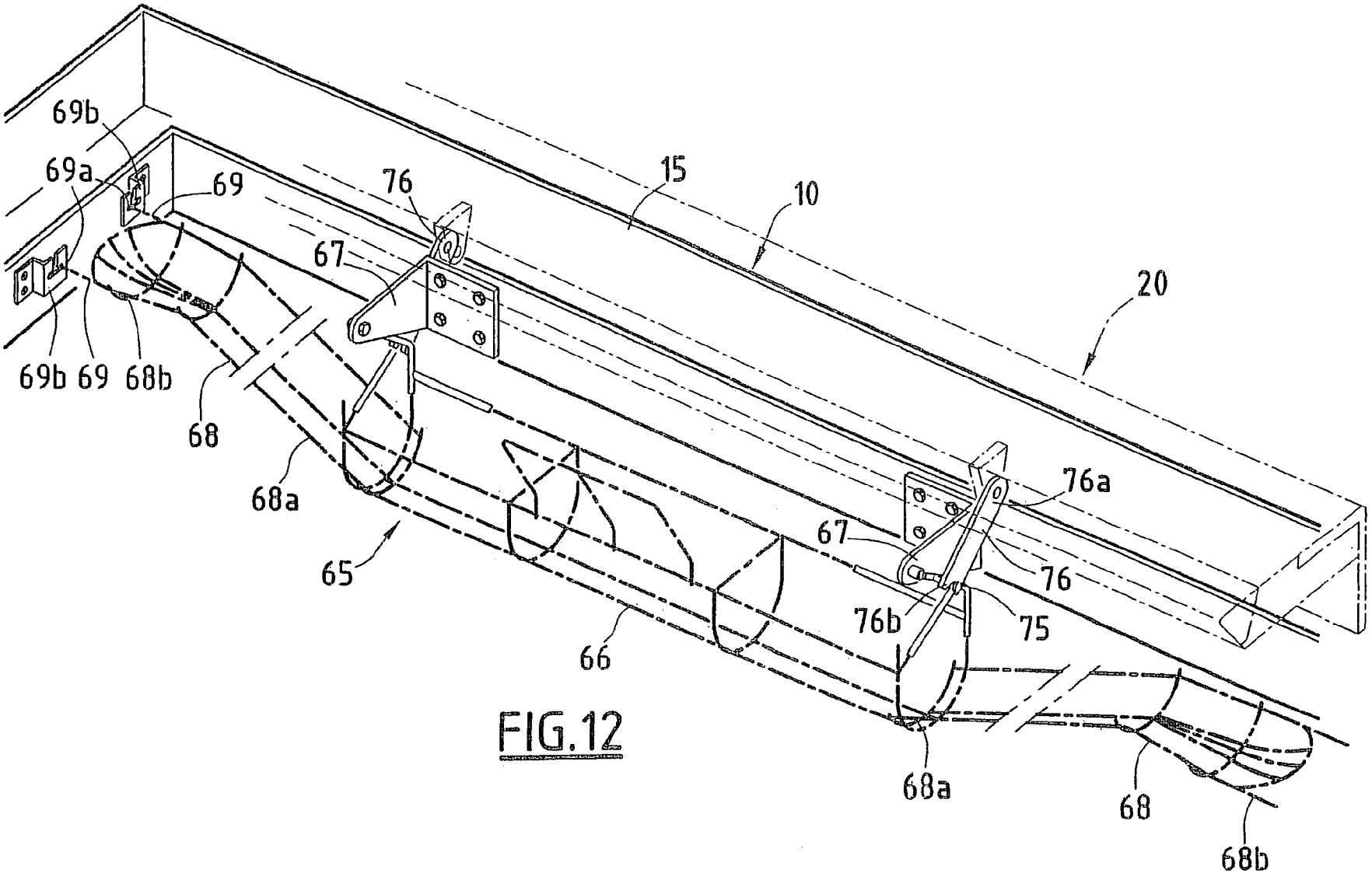
FIG. 12 is a schematic perspective view of a gutter for recovering the balls in the configuration for American type billiards.
Figure 13:
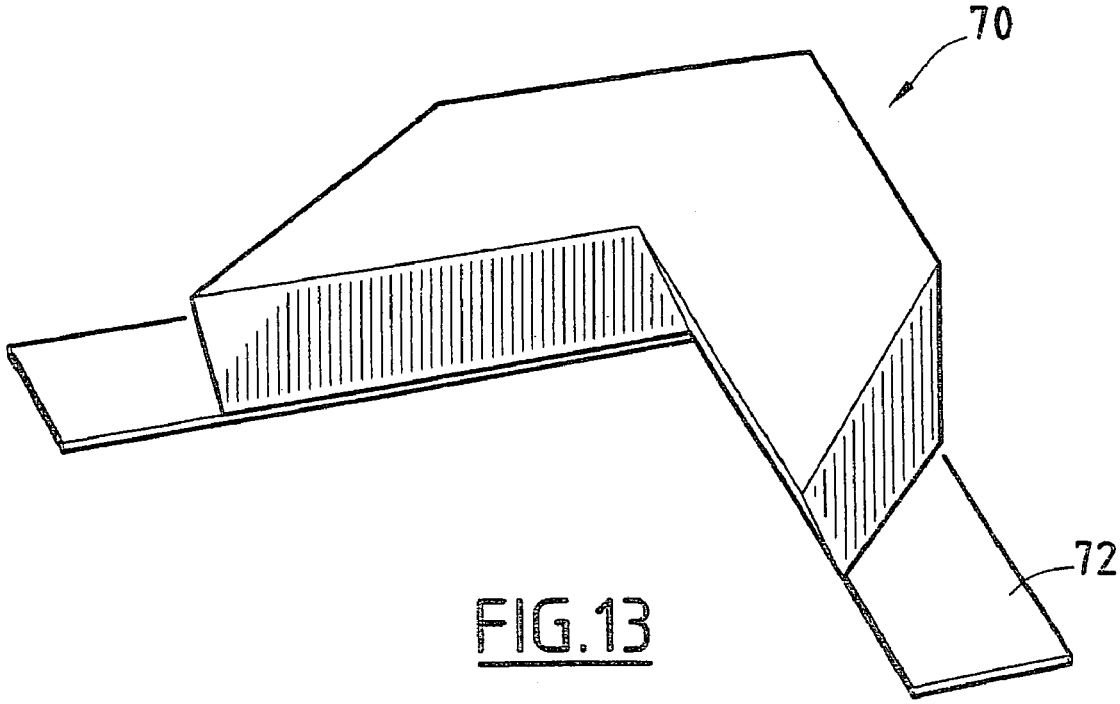
FIGS. 13 and 14 are two schematic perspective views of a closure member for the corners and centre of the assembly of bands in the configuration for French type billiards.

As FIG. 12 shows, the gutter 65 comprises a central portion 66 which is mounted so as to pivot on two brackets 67 which are fixed to the inner edge of the profile section 15 forming the adjacent long side of the fixed frame 10. The gutter 65 comprises, at each side of the central portion 66, a lateral portion 68 which comprises a first end 68*a* in contact with the adjacent end of the central portion 66. The lateral portion 68 comprises a second end 68*b* which is opposite the first end 68*a* and which is located near the profile section 15 of the short side which is adjacent to the long side of the fixed frame 10 carrying the central portion 66.

As FIG. 12 shows, the second end 68*b* of each lateral portion 68 comprises two parallel rods 69 which are each arranged in a recess 69*a* which is provided in a bracket 69*b* fixed to the profile section 15 of the short side of the fixed frame 10.

The central portion 66 in the form of a basket comprises, at the upper portion thereof and below each point of articulation to the bracket 67, a rod 75 which extends in parallel with the longitudinal axis of the central portion 66. Each rod 75 is connected to the movable frame 20 by a strut 76. To that end, each strut 76 comprises a first end 76*a* which is articulated to the movable frame 20 and a second end 76*b* which is articulated to the rod 75 of the central portion 66 of the gutter 65. Preferably, the second end 76*b* of each strut 76 is in the form of a fork, inside which the rod 75 is arranged. In this manner, when the movable frame 20 is lowered, each strut 76 applies a thrusting force to the corresponding rod 75, which brings about the tilting of the central portion 66 about each point of articulation to the brackets 67. During this pivoting, the end 68 of each lateral portion 68 slides in the central portion 66. Therefore, the gutter 65 is in a retracted position.

When the movable frame 20 is raised again, the central portion 66 of each gutter 65 pivots, under the action of the struts 76, about the points of articulation to the brackets 67 and is therefore displaced from the retracted position into the deployed position in order to recover the balls which fall through the recesses 25 and 26.

In this manner, each gutter 65 can be displaced by pivoting between a rest position which is retracted in the location of the free space 14 between the fixed frame 10 and the plate 13 into the lower position of the movable frame 20 and an active position below this annular space 14 in order to recover the balls in the upper position of the movable frame, in the configuration for American type billiards.

Figure 14:
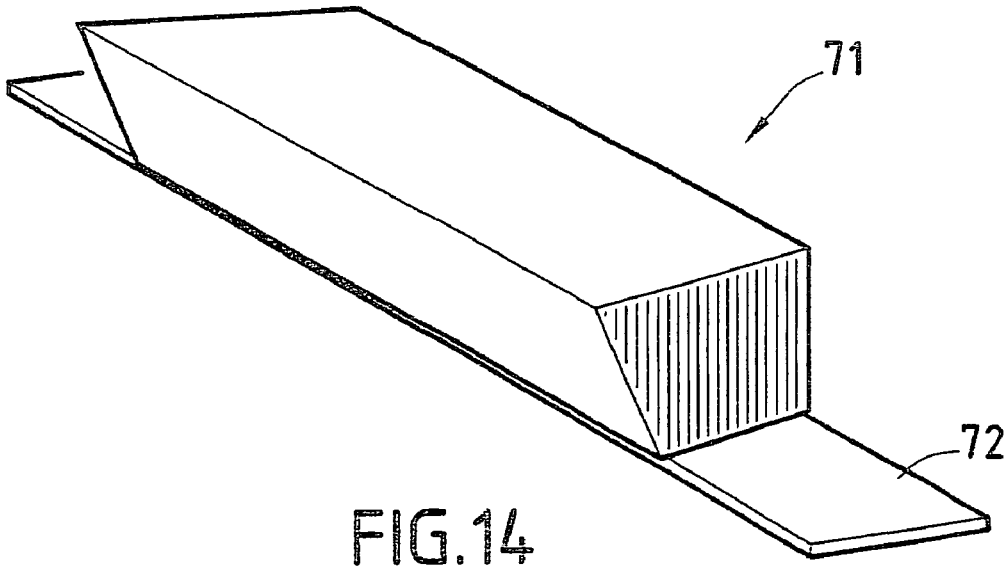

In the configuration for French type billiards, the recesses 25 are temporarily closed by a removable closure member 70 in the form of a block which has the same profile as the assembly of bands 23 and which brings about the joint between the long side and the short side of this assembly of bands 23. Similarly, each recess 26 is closed by a removable closure member 71 (FIG. 14) which is in the form of a band portion. This closure member 71 has a profile identical to that of the bands 23.

The closure members 70 and 71 are provided, at the underside and at each side, with a panel 72 which comprises an impression 73 on the lower face thereof. Each panel 72 is intended to co-operate with a housing of complementary shape which is not illustrated and which is arranged below the band 23 at each side of the recesses 25 and 26. Each housing is provided with a ball (not illustrated) which is intended to rest on each panel 72 when each closure member 70 and 71 is positioned in the corresponding recess 25 and 26 in order to hold them in place. In this position, each gutter 65 is retracted and its shape is defined to allow the balls to remain in the gutter.

Finally, as shown in FIG. 5, the table 1 comprises a drawer 80 which is fixed by appropriate means of the conventional type to the cross-pieces 12. This drawer 80 is intended for storing the panels 2 and the billiard cues. To this end, it can be displaced between a retracted position below the plate 13 and a position spaced apart from this plate 13 in order to allow the panels 2 and billiard cues to be stored.

When the table 1 is positioned in the configuration of a conventional table, as shown in FIG. 1, the movable frame 20 is in the lower position. The cloth of the central plate 13 is covered by the protection panels 2.

If the user wishes to use the table 1 as a table for board games, it is simply necessary for him to turn over one or more panels 2 in order to cause the patterns 3 for the games printed on the other face of these panels 2 to appear, as shown in FIG. 2.

If the user wishes to use the table 1 for billiards, he removes the panels 2 in order to expose the central plate 13. Next, he turns the crank 31 so as to cause the rods 34*a* and 34*b* and the rods 36 and 38 to rotate by means of the bevel gears 33, 35 and 37. These rods cause the screw portions 48 and 49 to rotate, which brings about the displacement of the carriages 43 and 46 of each runner 40 towards each other and, consequently, simultaneously the lifting of the assembly of the runners 40 and, consequently, the movable frame 20. During the rotation of the rods and in particular the rod 34*b*, the carriage 56 is displaced in the direction of the stop 60.

If the user wishes to play American billiards, he displaces the lever 62 in order to position the latch 61 between the nut 57 of the carriage 56 and the fixed stop 60. He continues to rotate the crank 31 until the carriage 56 is stopped against the latch 61. In this position, the assembly of bands 23 is located at a height in the order of 35 mm (1.38 inches) relative to the central plate 13, which corresponds to the height for American billiards.

The user carries out the withdrawal of the closure members 70 and 71 in order to open up the recesses 25 and 26 and, in this configuration, the gutters 65 are deployed below these recesses in order to be able to recover the balls.

In order to use the billiard table for French type billiards, the user re-positions the closure members 70 and 71 in the recesses 25 and 26, respectively, then he displaces the lever 62 in order to retract the latch 61 in order to open up the space between the nut 57 and the fixed stop 60. Next, the user rotates the crank 31 in order to bring, by means of the rods 34*a*, 34*b*, 36 and 38, screw portions 48 and 49 and struts 42 and 45, the runners 40 into the second upper position which corresponds to the position of the assembly of bands 23 for French billiards and at a height in the order of 38 mm (1.5 inches) relative to the central plate 13.

In order to bring the table 1 either into the configuration for American billiards or into the configuration for a conventional table, the user rotates the crank 31 in the opposite direction.

The convertible table according to the invention allows, by simple means, the table to be converted for French type billiards or American type billiards, whilst still having the appearance of a conventional table. It also provides a quality of play which is completely comparable to nonconvertible billiard tables.

The table according to the invention further has another advantage which consists in that, in the table configuration, the covering panels are at a height in the order of 75 cm (29.53 inches) which corresponds to a normal table height. It is possible to comply with this height because of the lowering of the movable frame, that is to say, the assembly of bands, in this configuration.

The invention claimed is:

1. A table that is convertible into different types of billiard tables, said table comprising:

a rectangular central plate covered with a cloth, a rectangular fixed frame having vertical support legs, said fixed frame surrounds said rectangular central plate and is connected thereto, and a rectangular movable frame arranged above the fixed frame and having an internal wall structure with cushioned portions, the movable frame being displaceable by control means vertically between a lower position, forming a table, and two upper positions, in said two upper positions, an inner edge of the wall structure is, relative to the central plate, at a height for American billiards, then at a height for French billiards, respectively.

2. A table according to claim 1, wherein the fixed frame provides, with a peripheral edge of the central plate, an annular free space for positioning the wall structure in the lower position of the movable frame.

3. A table according to claim 1, wherein the movable frame comprises, in the region of each leg of the fixed frame, a vertical cover which covers at least partially a corresponding leg.

4. A table according to claim 1, wherein, in the lower position of the movable frame, the central plate is covered by at least one reversible protection panel.

5. A table according to claim 1, wherein the sides of the fixed frame are formed by U-shaped profile sections, which accommodate means for controlling the displacement of the movable frame therein.

6. A table according to claim 5, wherein the means for controlling comprise at least two horizontal runners arranged at two opposite sides of the fixed frame and supporting the movable frame, the runners each being displaceable simultaneously and vertically by an assembly of struts between a position retracted inside the profile section of the fixed frame, corresponding to the lower position of the movable frame, and two deployed positions, each corresponding to an upper position of the movable frame.

7. A table according to claim 6, wherein a total of four runners are arranged in pairs at each long side of the fixed frame and are each associated with a respective assembly of struts.

8. A table according to claim 6, wherein each assembly of struts comprises two pairs of opposite struts, each having a first end articulated to a corresponding runner and a second end articulated to a carriage arranged in a corresponding profile section of the fixed frame, the carriages of the two pairs of struts of a same assembly being displaceable towards each other by actuation elements between the retracted position and the deployed positions of the corresponding runner and away from each other between the deployed positions and the retracted position of the corresponding runner.

9. A table according to claim 8, wherein the actuation elements comprise a nut fixedly joined to each carriage and two worm screw portions for movement in translation, each co-operating with a nut, the screw portions of the carriages of a same assembly of struts having threads of the opposite direction and the screw portions of the carriages of the assemblies of struts being connected to each other and caused to rotate by rods, said rods rotating by an operating member.

10. A table according to claim 9, wherein the rods are, at the corners of the fixed frame, connected to each other by bevel gears.

11. A table according to claim 9, wherein the worm screw portions, the rods and the bevel gears are arranged inside the profile sections of the fixed frame.

12. A table according to claim 9, wherein the operating member comprises a crank positioned outside one of the sides of the fixed frame and being connected to the rods by a bevel gear.

13. A table according to claim 9, further comprising means for blocking rotation of the rods and screw portions in each upper position of the movable frame.

14. A table according to claim 13, wherein the means for blocking comprise a carriage arranged in one of the profile sections of the fixed frame and which comprises a nut which engages with a worm screw portion that rotates by one of the rods, a fixed stop arranged in the continuation of the worm screw portion and a latch which can be tilted vertically between a retracted position, opening up the space between the nut and the stop, and a position interposed between the nut and the stop.

15. A table according to claim 1, wherein the wall structure comprises, at each corner and at a center of long sides, a circular-arc-shaped recess intended to be closed temporarily by a removable closure member when the movable frame is in the position for French billiards.

16. A table according to claim 1, further comprising, below each long side of the fixed frame, a longitudinal gutter that is displaceable by the movable frame between a rest position retracted in an annular free space between the fixed frame and the central plate in the lower position of the movable frame, and an active position below the annular free space in order to recover balls in the first upper position of the movable frame.

17. A table according to claim 1, further comprising, below the central plate, a retractable storage drawer.

18. A table that is convertible into different types of billiard tables, comprising:

a rectangular fixed frame having vertical support legs and surrounding a rectangular central plate, said central plate being covered with a cloth and being supported by said fixed frame;

a rectangular movable frame surrounding said fixed frame and including an assembly of resilient members on an inner surface thereof; and a control mechanism for vertically displacing said movable frame with respect to said fixed frame between a lower position, wherein an upper surface of said fixed frame is substantially coplanar with said central plate and forming a table, and two upper positions, in a first of said upper positions, an inner edge of the assembly of resilient members is at a height for American billiards relative to the central plate and in a second of said upper positions, said inner edge of the assembly of resilient members is at a height for French billiards.

19. A table that is convertible into different types of billiard tables, comprising:

a rectangular fixed frame having a central opening and vertical support legs;

a rectangular central plate within said central opening, said central plate being covered with a cloth and being supported by said fixed frame;

a rectangular movable frame overlying said fixed frame and including an assembly of resilient members on an inner surface thereof; and a control mechanism between said fixed frame and said movable frame for vertically displacing said movable frame with respect to said fixed frame between a lower position forming a table, and two upper positions, in a first of said upper positions, an inner edge of the assembly of resilient bands is at a height for American billiards relative to the central plate and in a second of said upper positions, said inner edge of the assembly of resilient bands is at a height for French billiards.

* * * * *